United States Patent [19]

Groddeck et al.

[11] Patent Number: 4,936,417

[45] Date of Patent: Jun. 26, 1990

[54] LUBRICATING SYSTEM WHICH INCLUDES A SPLASH COOLING OF THE PISTONS OF AN INTERNAL-COMBUSTION ENGINE

[75] Inventors: Michael Groddeck, Meckenbeuren; Otto Reifenscheid, Friedrichshafen; Gerd-Michael Wolters, Immenstaad, all of Fed. Rep. of Germany

[73] Assignee: MTU Friedrichshafen Gmbh, Friedrichshafen, Fed. Rep. of Germany

[21] Appl. No.: 368,798

[22] Filed: Jun. 20, 1989

[30] Foreign Application Priority Data

Jun. 24, 1988 [DE] Fed. Rep. of Germany ..... 3821302

[51] Int. Cl.[5] ..... F01M 1/00

[52] U.S. Cl. ..... 184/6.8; 184/18

[58] Field of Search ..... 184/6.5–6.8, 184/18

[56] References Cited

U.S. PATENT DOCUMENTS 1,996,817 4/1935 Mack ..... 184/6.8
2,800,119 5/1955 Schmidl .
2,991,770 7/1961 Rausch .

FOREIGN PATENT DOCUMENTS 708798 7/1941 Fed. Rep. of Germany ..... 184/6.5
26325 8/1970 Japan ..... 184/6.5

*Primary Examiner*—Carroll B. Dority
*Attorney, Agent, or Firm*—Barnes & Thornburg

[57] ABSTRACT

A lubricating system is disclosed which includes a splash cooling of the pistons of an internal-combustion engine by spraying nozzles, the cooling jets of which are aimed at the interior surfaces of the pistons. In order to achieve, after the start of an internal-combustion engine, a rapid buildup of the lubricant pressure, the lubricant supply to the spraying nozzles is interrupted in this initial operating phase. Since, in the starting phase, the lubricating oil supply to the camshafts can be reduced considerably or can even be switched off completely without damaging the bearings, the spraying nozzles and the camshafts receive a common lubricating oil supply which can be controlled centrally by means of control valves. It is advantageous that already existing lubricant ducts may be used, and the spraying nozzles can be constructed in a simple manner without any integrated control valves. It is also advantageous that the spraying nozzles must no longer be arranged at the central main duct above the crankshaft, which is disadvantageous with respect to accessibility and space conditions, but in the area of the camshafts which, in the case of a V-Engine, may be arranged in an advantageous lateral crankcase area.

6 Claims, 1 Drawing Sheet

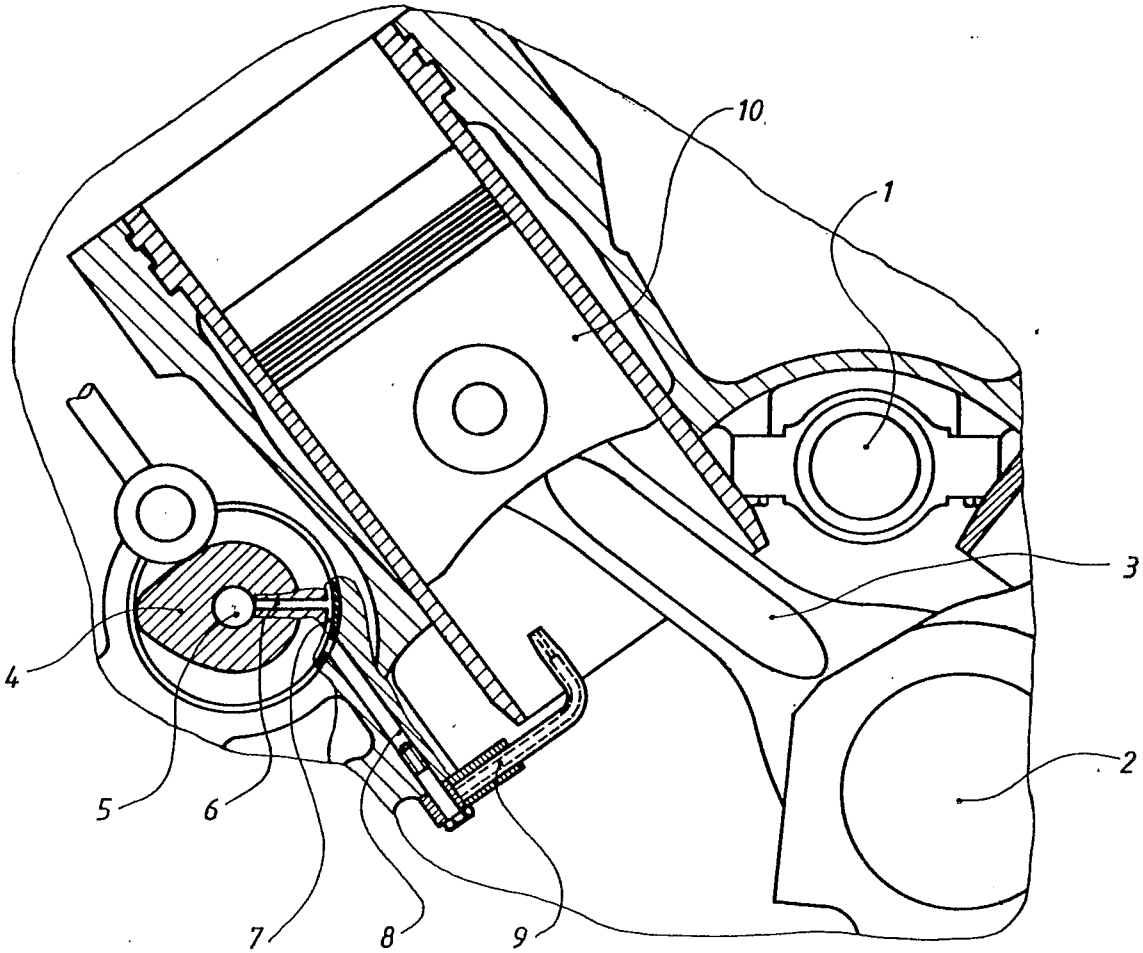
1
2
3
4
5
6
7
8
9
10

LUBRICATING SYSTEM WHICH INCLUDES A SPLASH COOLING OF THE PISTONS OF AN INTERNAL-COMBUSTION ENGINE

BACKGROUND AND SUMMARY OF THE INVENTION

The invention relates to a lubricating system which includes a splash cooling of the pistons of an internal-combustion engine by means of spraying nozzles. The dissertation by Stefan Zima concerning the "Entwicklung schnellaufender Hochleistungsmotoren in Friedrichshafen" ("Development of High-Speed High-Efficiency Engines in Friedrichshafen"), Volume 2, 1984, Page 551, which was approved by Fachbereich 11 Konstruktion und Fertigung der Technischen Universitat Berlin (Technical Section 11 Construction and Manufacturing) of Technical University Berlin In the initially cited dissertation by Stefan Zima, the cross-section of an internal-combustion engine is shown, in which the lubrication points at the crankshaft and at the connecting rods are supplied with lubricating oil through a central main duct to which the spraying nozzles for the cooling of the pistons are also connected. Lubricant ducts, which are separate in this respect and which are provided in the camshafts in the form of longitudinal bores, are used for feeding lubricating oil to the lubrication points at the camshafts and the valve timing gear of the internal-combustion engine. In internal-combustion engines, in which the spraying nozzles are connected to the main duct, the cooling of the pistons is interrupted after the start and during idling in order to have a sufficient amount of lubricating oil available for the lubricating of the lubrication points of the internal-combustion engine. For this purpose, control valves are used which stop the passage of the lubricating oil to the spraying nozzles as a function of the lubricant pressure, one control valve respectively being assigned to each spraying nozzle. Spraying nozzles of this type with assigned control valves are described, for example, in German Published Unexamined Application (DE-OS) No. 16 01 435. It is a disadvantage that the spraying nozzles combined with the control valves represent expensive components.

From German Patent No. (DE-PS) 27 20 034 it is known to assign the spraying nozzles for the cooling of the pistons to a separate lubricant duct which is used only for the feeding of cooling oil to the spraying nozzles. For the interruption of the cooling of the pistons, a single control valve is used by means of which the cooling oil supply to the lubricant duct and thus to all spraying nozzles is switched off simultaneously in the corresponding operating conditions of the internal-combustion engine. It is disadvantageous that a separate lubricant duct must be provided which is used only for the feeding of cooling oil to the spraying nozzles. In the narrow space conditions in modern engines, an additional lubricating oil duct, which extends along the whole length of the engine, as a rule, can be implemented only if other disadvantages are accepted.

An object of the invention is to ensure the lubrication of the main lubrication points of the internal-combustion engine during the starting phase, but using simple spraying nozzles without any integrated control valves for the cooling of the pistons and minimizing the overall expenditures for the system for the cooling of pistons In the case of a device of this type, this object is achieved according to preferred embodiments of the invention by supplying the cooling nozzles with lubricating oil from lubricant ducts for supplying the camshafts and by providing that the amount of lubricating oil reaching the camshafts through the lubricant ducts is controlled as a function of engine operating conditions. In contrast to the other lubrication points of the internal-combustion engine, the supply of the lubricant to the lubrication points of the camshafts is not necessary with the exception of a small reduced quantity or even completely some time after the internal-combustion engine is started. The supply of a minimum amount of oil or the residual oil existing at the lubrication points of the camshafts ensures a sufficient lubrication. Therefore the feeding of the lubricating oil to the camshafts and to the spraying nozzles may take place by a joint lubricating oil duct, which, in the starting phase of the internal-combustion engine to the buildup of a sufficient lubricating oil pressure, contains an amount of lubricant that is reduced to a minimum or is separated completely from the lubricating oil supply system. The cooling of the pistons is not desirable in the starting phase, and also does not take place as a result of a lack of a sufficient feeding of oil. The interruption of the cooling of the pistons in operating conditions other than the starting phase is not necessary if the output of the lubricant pump is sufficient. An excessive cooling of the pistons during the idling operation of the internal-combustion engine cannot take place even if the cooling is not interrupted if, as customary in today's engines, the oil temperature is controlled by thermostats.

It is particularly advantageous that the spraying nozzles are no longer arranged in the central crankcase area above the crankshaft which is narrow in space and hard to reach, but that these spraying nozzles are now located in more easily accessible, less narrow lateral areas of the crankcase in which the camshafts are disposed.

Other objects, advantages and novel features of the present invention will become apparent front the following detailed description of the invention when considered in conjunction with the accompanying drawings.

BRIEF DESCRIPTION OF THE DRAWING

FIG. 1 is a fragmentary cross-sectional view in the area of one cylinder of an internal-combustion engine having cylinders which are arranged in a V-shape;

FIG. 2 is a schematic of a starting control for the cam shaft lubricating duct; and FIG. 2(*a*) is an alternative starting control from that of FIG. 2.

DETAILED DESCRIPTION OF THE DRAWING

In the fragmentary cross-sectional view of an internal-combustion engine shown in the figure, a central main duct 1, which is arranged in a %,shape between the cylinder banks of the internal-combustion engine, is used for the supply of the lubrication points at the crankshaft 2 and the connecting rods 3 as well as other lubrication points of the internal-combustion engine. The pipes and ducts which branch off the main duct 1 and lead to the lubrication points are not shown in detail. For supplying the lubrication points at the camshafts 4 and possibly also the valve timing gear, which is not shown, with lubricating oil, lubricant ducts 5 are used which are formed as longitudinal bores in the camshafts 4. From the lubricant duct 5 of a camshaft 4, bores 6 lead to the lubrication points at the outer surface of the camshaft 4. After the lubricating oil has emerged from the lubrication surfaces of the camshaft bearings, it reaches the ring grooves 7 which, by means of oil feeding pipes 8, are connected with the spraying nozzles 9 for the cooling of the pistons. The lubricating oil coming out of the spraying nozzles 9 and dripping off the pistons 10 arrives in a common lubricant sump of the internal-combustion engine, whence, by means of a lubricant pump which is not shown, it is fed to the lubrication points of the internal-combustion engine in a new circulating cycle.

In a manner schematically control valves 11 and 11' are assigned to the lubricant ducts 5. By means of these control valves 11 and 11', for example, as a function of the lubricant pressure, the feeding of lubricant to the lubricant ducts 5 can be reduced or switched off in the starting phase of the internal-combustion engine. The control valves each have a closable main bore 12 (see FIG. 2(*a*) and possibly a by-pass bore which permits a reduced lubricant flow. In this case, the cross-section of the main bore is considerably larger than that of the by-pass bore 12. It was found that the bearing points at the camshafts 4 and also the lubrication points of the valve timing gear withstand a considerable reduction of the lubricating oil supply without any negative effects in the starting and warm-up phase of the internal-combustion engine. As a rule, an amount of residual oil is present at the mentioned lubrication points that is sufficient for the lubrication so that it would even be possible to completely switch off the lubricating oil supply. However, the lubricant requirement in the starting phase permits a coupling of the lubricating oil supply of the camshafts 4 with the lubricating oil supply of the spraying nozzles 9 because a cooling of the pistons must not take place in the starting phase and therefore no lubricating oil is required for this purpose. The reduced amount of lubricant required at the camshafts is not sufficient for the forming of spraying jets at the spraying nozzles. Since the reduction of the lubricating oil supply to the camshafts 4 takes place by central control valves 11 and 11' assigned to the lubricant ducts 5, this results in the advantage that the spraying nozzles 9 may be constructed as simple components without any respective integrated control valve. It is also advantageous that, in the case of the shown V-engine, the spraying nozzles 9 are no longer arranged in the central area at the main duct, where the space conditions are very narrow, but are located on the sides of the crankcase in the area of the lubricant ducts 5 where the accessibility and the space conditions are much better. It is naturally also advantageous that it is not necessary to provide a separate lubricant pipe which is used only for the feeding of cooling oil to the spraying nozzles 9, and the control of the supply of lubricating oil to the spraying nozzles can nevertheless take place by means of a central control valve.

When the engine is warmed up, a reduction or switching-off of the lubricating oil supply to the camshafts 4 is not provided. Thus, also when the internal-combustion engine is idling, the spraying nozzles 9 remain connected to the lubricating oil supply. As the result of a sufficiently dimensioned lubricant pump, it is ensured that nevertheless all lubrication points of the internal-combustion engine are sufficiently supplied with lubricating oil. An excessive cooling of the pistons 10 of the internal-combustion engine as a result of an uninterrupted splashing with lubricating oil does not have to be feared, if the engine is equipped with a thermostat or other suitable de%.ices which do not permit the lubricating oil temperature to fall below a predetermined value.

Although the present invention has been described and illustrated in detail, it is to be clearly understood that the same is by way of illustration and example only, and is not to be taken by way of limitation The spirit and scope of the present invention are to be limited only by the terms of the appended claims.

What is claimed:

1. A lubricating system for a reciprocating piston internal-combustion engine, comprising:

main lubricant duct means extending in longitudinal direction of the engine and connected with main branch duct means for supplying lubricant to lubricating points of an engine crankshaft and to piston connecting rods, camshaft lubricant duct means for supplying engine camshafts with lubricating oil, spraying nozzle means for cooling the piston by spraying lubricating oil thereon, and spraying nozzle supply duct means operatively connected to the camshaft lubricant duct means to supply the spraying nozzle means with lubricating oil.

2. A lubricating system for a reciprocating piston internal-combustion engine according to claim 1, wherein there are control means for controlling the supply of lubricant to the camshaft lubricant duct means as a function of an engine operating condition, whereby during cold engine start up the supply is reduced as compared to normal heated engine operation.

3. A lubricating system according to claim 1, wherein there are control means for controlling the lubricating oil supply to the camshaft that can be switched off completely to stop the supply of lubricating oil via the camshaft lubricant duct means.

4. A lubricating system according to claim 1, wherein longitudinal bores located in the camshafts serve as the camshaft lubricant duct means, wherein bores lead from the longitudinal bores to the outer surface of the camshafts to communicate lubricating oil to the lubrication points at the camshafts, and wherein the lubricating oil emerging at the lubrication points at the camshafts reaches the spraying nozzles by means of oil feeding pipes forming the spraying nozzle supply duct means.

5. A lubricating system according to claim 2, wherein longitudinal bores located in the camshafts serve as the camshaft lubricant duct means, wherein bores lead from the longitudinal bores to the outer surface of the camshafts to communicate lubricating oil to the lubrication points at the camshafts, and wherein the lubricating oil emerging at the lubrication points at the camshafts reaches the spraying nozzles by means of oil feeding pipes forming the spraying nozzle supply duct means.

6. A lubricating system according to claim 3, wherein longitudinal bores developed in the camshafts serve as the camshaft lubricant duct means, wherein bores lead from the longitudinal bores to the outer surface of the camshafts to communicate lubricating oil to the lubrication points at the camshafts, and wherein the lubricating oil emerging at the lubrication points at the camshafts reaches the spraying nozzles by means of oil feeding pipes forming the spraying nozzle supply duct means.

* * * * *